US006923999B2

(12) United States Patent
Graf

(10) Patent No.: US 6,923,999 B2
(45) Date of Patent: Aug. 2, 2005

(54) PROCESS FOR THE MANUFACTURE OF BOARDS OF LIGNEOUS MATERIAL

(75) Inventor: Matthias Graf, Bretten (DE)

(73) Assignee: Dieffenbacher GmbH + KG, Eppingen (DE)

( * ) Notice: Subject to any disclaimer, the term of this patent is extended or adjusted under 35 U.S.C. 154(b) by 0 days.

(21) Appl. No.: 10/178,789

(22) Filed: Jun. 25, 2002

(65) Prior Publication Data

US 2003/0001305 A1 Jan. 2, 2003

(30) Foreign Application Priority Data

Jun. 25, 2001 (DE) ..... 101 30 526

(51) Int. Cl.[7] ..... B05D 1/36; B05D 5/02; B05D 3/12

(52) U.S. Cl. ..... 427/201; 427/202; 427/370; 427/397

(58) Field of Search ..... 427/201–205, 427/369, 370, 397; 264/109, 119–128

(56) References Cited

U.S. PATENT DOCUMENTS 4,109,041 A * 8/1978 Tellman ..... 428/147
4,221,758 A * 9/1980 Burkey et al. ..... 264/225
6,312,632 B1 11/2001 Graf

FOREIGN PATENT DOCUMENTS

DE 197 18 770 A1 11/1998
DE 197 18 771 A1 11/1998

* cited by examiner

*Primary Examiner*—Fred J. Parker
(74) *Attorney, Agent, or Firm*—Foley & Lardner LLP

(57) ABSTRACT

A process for manufacturing ligneous material board with improved surface slip-resistance. The process includes an additional spreading station which spreads fine particles onto the upper and lower covering layers to obtain slip-resistant textured surfaces.

16 Claims, No Drawings

PROCESS FOR THE MANUFACTURE OF BOARDS OF LIGNEOUS MATERIAL

BACKGROUND OF THE INVENTION

The invention relates to a process for the manufacture of ligneous material boards. The term "ligneous material boards" includes flake boards and fiber boards, especially oriented strand boards (OSB) with textured surfaces on one or both sides. One form of the process involves spreading a mat of material to be cured under pressure and heat in a press from a spreading station in several layers with a mixture of lignocellulose- and/or cellulose-containing particles, such as shavings, fibers and chips to which a binding agent is added where the fine particles from the binding agent mixture are put mainly into the middle layer of the mat of material and the coarse particles are put mainly into the covering layers of the mat of material. Such a process, from which the invention sets out, is the subject of German patent applications DE 197 18 770 A1, filed May 3, 1997, and DE 197 18 771 A1, filed May 3, 1997, both of which are hereby incorporated by reference.

The above-referenced German patent applications disclose a process that provides an already fully cured ligneous material board, coming cold from storage or still hot after leaving the hot press, with a screen impression on one or both surfaces. The screen impression is applied mainly to improve the slip and stick properties of the ligneous material board. In the disclosed process, both in cyclical multiple-stage and in single-stage presses as well as in a continuously operating press, a texturing process takes place immediately at the discharge, which can be performed selectively for the production of textured surfaces, with the result that the heat still present in the freshly pressed ligneous material board with its high plasticity can be utilized before the board is put aside (stored) for cooling.

In the manufacture of oriented strand boards (OSB), in which this embossing process is mostly used, attention is increasingly given to see that the wood shavings of the two covering layers have the optimum possible geometry for achieving maximum flexural strengths. The flake geometry in the case of conventional OSB manufacture amounts to flake lengths of 100 mm to 120 mm, flake widths of 20 mm to 50 mm, and flake thickness of 0.4 mm to 0.8 mm. This circumstance results, as desired, in the best possible flexural strengths with minimum use of material. Usually, the fines that are formed in the flake production are sifted out and either fed to the middle layer or burned. Also, the spreader heads of the molding station are constructed so that any fines content in the cover layer material tends to be spread closer to the middle of board.

The present invention relates to a further development of the process described in the German patent applications above. For it has been found that, due to this method of procedure, no fines content is found on the surfaces of the boards in modern OSB production plants. The surfaces of the boards, therefore, are very slick and despite the texturing are less slip-resistant and less securely bonded.

SUMMARY OF THE INVENTION

One problem addressed by the present invention is to find a process whereby it is possible to avoid the disadvantages mentioned in order to obtain slip-resistant textured surfaces on the manufactured ligneous material board.

According to an embodiment of the present invention, a process is provided in which fines, sawdust, or short-chopped flakes having a substantially cubic geometry are spread from an additional spreading station onto upper and/or lower covering layers of a raw mat of material. The process includes a spreading station that spreads a mat of material in several layers with a mixture of particles wherein the mixture is composed of lignocellulose-containing particles, cellulose-containing particles, or lignocellulose- and cellulose-containing particles to which a binding agent is added. During spreading, the fine particles from the mixture are put mainly into the middle layer of the mat of material and the coarse particles from the mixture are put mainly into the covering layers of the mat of material. An additional spreading station spreads fines having a substantially cubic geometry onto at least one covering layer of the mat of material. The mat of material is cured in a press by the application of pressure and heat.

According to the embodiment of the present invention summarized above, non-glued fines may also be used. It is also advantageous if the glued or non-glued fines are spread onto at least one covering layer of the mat of material in the amount of about 5 $g/m^2$ to 30 $g/m^2$ per side. In another embodiment, glue-coated fines are spread onto at least one surface of the ligneous board material after the ligneous board material has been cured under pressure and heat in a press but before entry into the embossing press.

According to another embodiment of the present invention, a process for manufacturing embossed ligneous material board is provided. The process includes providing a mixture of a binding agent and lignocellulose-containing and/or cellulose-containing particles and spreading the mixture to form a mat having upper and lower surfaces. The process further includes spreading fine particles onto the upper and lower covering layers, curing the mat with heat and pressure in a press, and embossing the board.

Thus, a ligneous board material produced according to the present invention has improved slip and stick properties. The present invention includes additional advantageous measures as discussed below with regard to further embodiments of the invention.

DETAILED DESCRIPTION OF THE PREFERRED EMBODIMENTS

The present invention includes a process for the production of ligneous material boards, such as flake boards and fiber boards, especially oriented strand boards (OSB) with textured surfaces on one or both sides.

For the solution of the problems identified above, fines, sawdust or short-chopped flakes are spread from an additional spreading station onto the upper and/or onto the lower covering layer of the raw mat, and the flakes have a cubic flake geometry.

For an additional embodiment, glue-coated fines, sawdust or short-chopped flakes, after leaving the hot press and before entry into the embossing press are spread onto one or both surfaces of the ligneous material board.

With the present invention a process is expounded whereby the slip and stick properties of the oriented strand boards (OSB) are improved. To this end, in addition to the existing spreading station, a fines spreading means is provided for one or both cover layers. In the case of ligneous material boards that are to be textured, the fines are preferably spread onto the upper cover layer, since this procedure is easiest to accomplish by means of machinery and the fines that are spread are not lost at any transitions in the band.

The invention sets out from the knowledge that, to achieve a good slip and stick action, the screened-out material is not spread on directly, but preferably flakes cut to short lengths, which have insofar as possible a cubic chip geometry. With this cubic chip geometry, sharp-edged depressions are present in the board surfaces in spite of the subsequent pressing, even after the texturing, and these result in the desired improvement of the slip and stick properties. Sawdust is especially well qualified for this. These sawdust chips usually are produced in sufficient amounts around the seaming and dividing saws and can be more or less recycled. When the fines sifted out are used, an additional comminution is conceivable.

In this process of spreading cubic chips only a very small amount of about 5 g/m$^2$ to 30 g/m$^2$ is spread onto the mat, so that only a small percentage of the surface is occupied by cubic chips and in no way do any cubic chips occur in multiple layers. By this procedure, even unglued chip are used without problems, which are then nevertheless sufficiently bonded to the board by the gluing of the cover layer chips.

As used herein, the term fine particles includes fines, chips, sawdust, or flakes cut short.

The priority document here, German patent application DE 101 30 526.5, filed Jun. 25, 2001, was previously incorporated by reference and is now set out below.

The invention relates to a process for the manufacture of boards of ligneous material according to the preamble of embodiment 1.

It has become known from DE 197 18 770 A1 and DE 197 28 771 A1 that an already fully cured ligneous material board, coming cold from storage or still hot after leaving the hot press, is provided with a screen impression on one or both surfaces. The screen impression is applied mainly to improve the slip and stick properties of the ligneous material board. The advantage of the process according to the invention is that both in cyclical multiple-stage and in single-stage presses as well as in a continuously operating press, a texturing process takes place immediately at the discharge, which can be performed selectively for the production of textured surfaces, with the result that the heat still present in the freshly pressed ligneous material board with its high plasticity can be utilized before the board is put aside (stored) for cooling.

In the manufacture of OSB (oriented-strand boards) in which this embossing process is mostly used, attention is increasingly given to see that the wood shavings of the two covering layers have the optimum possible geometry for achieving maximum flexural strengths. The flake geometry in the case of conventional OSB manufacture amounts to flake lengths of 100 mm to 120 mm, flake widths of 20 mm to 50 mm and flake thicknesses of 0.4 mm to 0.8 mm. Usually the fines that are formed in the flake production are sifted out and either fed to the middle layer or burned. Also, the spreader heads of the molding station are constructed so that any fines content in the cover layer material tends to be spread closer to the middle of the board. Due to this method of procedure, no fines content is found on the surfaces of the boards in modem OSB production plants. This circumstance results, as desired, in the best possible flexural strengths with minimum use of material. Of course, the surfaces of the boards are very slick and despite the texturing they are less slip-resistant and less securely bonded.

The invention is addressed to the problem of finding a process whereby it is possible to avoid the disadvantages mentioned in order to obtain slip-resistant textured surfaces on the manufactured ligneous material board.

For the solution of these problems it is stated in the specific part of the embodiment that fines, sawdust or short-chopped flakes are spread from an additional spreading station onto the upper and/or onto the lower covering layer of the raw mat and the flakes have a cubic flake geometry.

For an additional embodiment, the solution in embodiment D is that glue-coated fines, sawdust or short-chopped flakes, after leaving the hot press and before entry into the embossing press are spread onto one or both surfaces of the ligneous material board.

With the present invention a process is expounded whereby the slip and stick properties of the OSB boards are improved. To this end, in addition to the existing spreading station, a fines spreading means is provided for one or both cover layers. In the case of ligneous material boards that are to be textured, the fines are preferably spread onto the upper cover layer, since this procedure is easiest to accomplish by means of machinery and the fines that are spread are not lost at any transitions in the band.

The invention sets out from the knowledge that, to achieve a good slip and stick action, the screened-out material is not spread on directly, but preferably flakes cut to short lengths, which have insofar as possible a cubic chip geometry. With this cubic chip geometry, sharp-edged depressions are present in the board surfaces in spite of the subsequent pressing, even after the texturing, and these result in the desired improvement of the slip and stick properties. Sawdust is especially well qualified for this. These sawdust chips usually are produced in sufficient amounts around the seaming and dividing saws and can be more or less recycled. When the fines sifted out are used, an additional comminution is conceivable.

In this process of spreading cubic chips only a very small amount of about 5 g/m$^2$ to 30 g/m$^2$ spread onto the mat, so that only a small percentage of the surface is occupied by cubic chips and in no way do any cubic chips occur in multiple layers. By this procedure, even unglued chips are used without problems, which then are nevertheless sufficiently bonded to the board by the gluing of the cover layer chips.

Embodiment A. Process for the manufacture of ligneous material boards such as flake boards/fiber boards, especially of oriented strand boards (OSB) with textured surfaces on one or both sides, in which a mat of the material to be pressed is spread from a spreading station in several layers with a mixture of lignocellulose-and/or cellulose-containing particles, such as shavings, fibers and chips to which binding agent is added, while from the binding agent mixture the fines are put mainly into the middle layer and the coarse particles into the covering layers of the mat of material to be pressed, and the mat of material is cured under pressure and heat in a press, characterized in that fines, sawdust or flakes cut short are spread onto the upper and/or onto the lower covering layer of the mat of material to be pressed, and the chips have a cubic geometry insofar as possible.

Embodiment B. Process according to embodiment A, characterized in that the fines, sawdust or flakes cut short are spread onto the covering layers amount to about 5 g/m$^2$ to 30 g/m$^2$ per side.

Embodiment C. Process according to embodiments A and B, characterized in that non-glued fines, sawdust or flakes cut short are used.

Embodiment D. Process for the manufacture of ligneous material boards, such as flake boards/fiber boards, especially oriented strand boards (OSB) with surfaces textured on one or both sides, in which a mat of material to be pressed is spread from a spreading station with one or more layers of a mixture of lignocellulose- and/or cellulose-containing particles such as shavings, fibers and chips treated with binding agent, while the fines from the binding agent mixture are put mainly into the middle layer and the coarse particles into the covering layers of the mat of material, and the mat is cured with pressure and heat in a press, characterized in that the glued fines, sawdust or flakes cut short are spread onto one or both surfaces of the ligneous material board before entry into the embossing press.

What is claimed is:

1. A process for manufacturing a ligneous material board, comprising the steps of:

providing a mixture of a binding agent and lignocellulose-containing particles, cellulose-containing particles, or lignocellulose- and cellulose-containing particles;

spreading the mixture to form a mat having upper and lower surfaces;

spreading fine particles having a substantially cubic geometry onto at least one of the upper and lower surfaces; and curing the mat in a press to thereby form a board having slip resistant textured surfaces.

2. The process of claim 1, wherein the steps of spreading the mixture and spreading fine particles are accomplished at different spreading stations.

3. The process of claim 1, wherein the mat includes more than one layer.

4. The process of claim 1, wherein the fine particles are non-glued.

5. The process of claim 1, wherein the fine particles are spread onto at least one of the upper and lower surfaces in the amount of about 5 $g/m^2$ to 30 $g/m^2$ per side.

6. The process of claim 5, wherein the fine particles are non-glued.

7. The process of claim 1, wherein the ligneous material board is an oriented strand board.

8. A process for manufacturing an embossed ligneous material board, comprising the steps of:

providing a mixture of a binding agent and lignocellulose-containing particles, cellulose-containing particles, or lignocellulose- and cellulose-containing particles;

spreading the mixture to form a mat having upper and lower surfaces;

curing the mat in a press to thereby form a board;

spreading glue-coated fine particles onto at least one of the upper and lower surfaces; and then embossing the board.

9. The process of claim 8, wherein the steps of spreading the mixture and spreading glue-coated, fine particles are accomplished at different spreading stations.

10. The process of claim 8, wherein the step of spreading the mixture to form a mat includes forming a mat having more than one layer.

11. The process of claim 8, wherein the step of spreading glue-coated fine particles includes spreading fine particles having a substantially cubic geometry.

12. The process of claim 8, wherein the ligneous material board is an oriented strand board.

13. A process for manufacturing an embossed ligneous material board, comprising the steps of:

providing a first mixture of a binding agent and lignocellulose-containing particles, cellulose-containing particles, or lignocellulose- and cellulose-containing particles;

spreading the first mixture to form a mat having upper and lower surfaces;

curing the mat in a press to thereby form a board;

spreading a second mixture of fine particles and a binding agent onto at least one of the upper and lower surfaces, wherein the step of spreading the second mixture includes spreading fine particles having a substantially cubic geometry; and then embossing the board.

14. The process of claim 13, wherein the step of spreading the first mixture takes place in front of a main press and the step of spreading the second mixture takes place in front of an embossing press at different spreading stations.

15. The process of claim 13, wherein the step of spreading the first mixture to form a mat includes forming a mat having more than one layer.

16. The process of claim 13, wherein the ligneous material board is an oriented strand board.

* * * * *